US011293186B2

(12) United States Patent
Prior

(10) Patent No.: US 11,293,186 B2
(45) Date of Patent: Apr. 5, 2022

(54) FACADE UNIT MOUNTING APPARATUS

(71) Applicant: JAMES & TAYLOR LIMITED, Surrey (GB)

(72) Inventor: Luke Prior, Surrey (GB)

(73) Assignee: JAMES & TAYLOR LTD, Surrey (GB)

( * ) Notice: Subject to any disclaimer, the term of this patent is extended or adjusted under 35 U.S.C. 154(b) by 0 days.

(21) Appl. No.: 16/956,569

(22) PCT Filed: Dec. 12, 2018

(86) PCT No.: PCT/GB2018/053604
§ 371 (c)(1),
(2) Date: Jun. 20, 2020

(87) PCT Pub. No.: WO2019/122820
PCT Pub. Date: Jun. 27, 2019

(65) Prior Publication Data

US 2021/0047836 A1 Feb. 18, 2021

(30) Foreign Application Priority Data

Dec. 21, 2017 (GB) ..... 1721631

(51) Int. Cl.
*E04F 13/08* (2006.01)
*E04F 13/14* (2006.01)

(52) U.S. Cl.
CPC ..... *E04F 13/0812* (2013.01); *E04F 13/142* (2013.01)

(58) Field of Classification Search
CPC ..... E04F 13/0801; E04F 13/0803; E04F 13/0812; E04F 13/0826; E04F 13/0862; E04F 13/14; E04F 13/142; E04F 13/147
See application file for complete search history.

(56) References Cited

U.S. PATENT DOCUMENTS 1,850,961 A * 3/1932 Mortenson ..... E04F 13/0801 52/387
2,005,030 A * 6/1935 Geisinger ..... E04F 13/0803 52/384

(Continued)

FOREIGN PATENT DOCUMENTS

BR MU9001775-7 U2 2/2013
DE 4315656 A1 * 11/1994 ..... E04F 13/0801

(Continued)

*Primary Examiner* — James M Ference
(74) *Attorney, Agent, or Firm* — Jason P. Mueller; FisherBroyles, LLP

(57) ABSTRACT

A facade unit mounting apparatus is disclosed. A first support attaches to a wall and includes a first base extending outwardly from the wall. The first support includes a plurality of resilient elements mounted to the first base which include a plurality of projections extending from the first base. A second support is configured to attach to the wall. The first and second supports grip at least one facade unit mounted between the first and second supports. The plurality of resilient elements are configured to bias the at least one facade unit against the second support. The plurality of projections are configured to extend inwardly and away from the first base to thereby grip the at least one facade unit against outward movement from the wall. Disclosed embodiments are suitable to interface with facade units such as brick slips, other fired clay units, masonry units, tiles, etc.

16 Claims, 8 Drawing Sheets

(56) References Cited

U.S. PATENT DOCUMENTS 2,016,918 A * 10/1935 Born ..... E04F 13/0801 52/385
2,043,706 A * 6/1936 Myers ..... E04F 13/0803 52/387
2,054,512 A * 9/1936 Kerner ..... E04F 13/0803 52/774
2,097,069 A * 10/1937 Klages ..... E04F 13/081 52/506.06
2,832,102 A * 4/1958 Amoruso ..... E04F 13/0826 52/386
2,882,713 A * 4/1959 Diehl ..... E04F 13/0803 52/387
2,924,963 A * 2/1960 Taylor ..... E04F 13/0846 52/509
3,005,293 A * 10/1961 Hunter ..... E04F 13/0805 52/385
3,321,883 A * 5/1967 Pascucci ..... E04F 13/0803 52/774
4,662,140 A * 5/1987 Porter ..... E04F 13/0885 52/385
4,856,246 A * 8/1989 Shimasaki ..... E04F 13/0803 52/386
4,890,433 A * 1/1990 Funaki ..... E04F 13/0803 52/386
4,916,875 A * 4/1990 Kashiwagi ..... E04F 13/0851 52/302.3
4,987,712 A * 1/1991 Mancuso ..... E04F 13/0862 52/387
5,191,745 A * 3/1993 Story ..... E04F 13/0812 52/127.8
5,228,937 A * 7/1993 Passeno ..... E04F 13/0801 156/297
5,373,676 A * 12/1994 Francis ..... E04F 13/0862 52/386
5,398,473 A * 3/1995 Chan ..... E04F 13/0812 52/235
6,098,363 A * 8/2000 Yaguchi ..... E04F 13/0801 52/385
6,164,029 A * 12/2000 Lee ..... E04F 13/0851 52/235
6,315,489 B1 * 11/2001 Watanabe ..... E04F 13/0846 403/381
6,802,165 B1 * 10/2004 Passeno ..... E04F 13/0862 52/288.1
6,830,405 B2 * 12/2004 Watanabe ..... E04F 13/0826 403/11
6,951,086 B2 * 10/2005 Passeno ..... E04F 13/0862 52/302.3
7,010,894 B1 * 3/2006 Cappelle ..... E04B 9/26 52/384
7,856,776 B2 * 12/2010 Van Der Lee ..... E04F 15/02 52/235
7,918,065 B2 * 4/2011 Ito ..... E04F 13/0826 52/506.05
8,141,310 B2 * 3/2012 Trezza ..... E04C 2/38 52/302.3
8,322,103 B1 * 12/2012 Kownacki ..... E04F 13/0733 52/506.05
8,621,801 B2 * 1/2014 Bouchard ..... E04G 21/1883 52/314
9,016,020 B1 * 4/2015 Yang ..... E04F 13/072 52/511
9,267,295 B2 * 2/2016 Mann ..... E04C 2/38
9,422,730 B2 * 8/2016 Curtis ..... E04F 19/024
9,464,442 B1 * 10/2016 Olczyk ..... E04F 13/0835
9,556,618 B2 * 1/2017 Streicher ..... E04F 13/072
2004/0050003 A1 * 3/2004 Passeno ..... E04F 13/14 52/384
2004/0065035 A1 * 4/2004 De Vlam ..... E04F 13/0862 52/384
2005/0102944 A1 * 5/2005 Hikai ..... E04F 13/0846 52/511
2005/0284063 A1 * 12/2005 Losse ..... E04F 13/14 52/384
2006/0272261 A1 * 12/2006 Ito ..... E04F 13/0846 52/586.1
2007/0151190 A1 * 7/2007 Huff ..... E04F 13/14 52/592.5
2008/0010922 A1 * 1/2008 Wagner ..... E04F 13/0812 52/235
2008/0155922 A1 * 7/2008 Wolf ..... E04F 13/0862 52/386
2012/0117904 A1 * 5/2012 Bouchard ..... E04F 13/0862 52/309.4
2012/0174516 A1 * 7/2012 Mann ..... E04F 13/0733 52/475.1
2012/0241574 A1 * 9/2012 Uota ..... E04F 13/0846 248/231.81
2012/0317909 A1 * 12/2012 MacKenzie ..... E04B 1/7076 52/288.1
2014/0290166 A1 * 10/2014 Bordener ..... E04F 13/083 52/474
2015/0191911 A1 * 7/2015 Mann ..... E04F 13/0805 52/475.1

FOREIGN PATENT DOCUMENTS

| | | | |
|---|---|---|---|
| DE | 102004046708 | A1 | 3/2006 |
| EP | 2299026 | A2 | 3/2011 |
| GB | 2199352 | A | 7/1988 |
| GB | 2371314 | A | 7/2002 |
| JP | 2001132194 | A | 5/2001 |
| WO | 2011/011891 | A1 | 2/2011 |

* cited by examiner

FACADE UNIT MOUNTING APPARATUS

This application is a national stage entry under 35 U.S.C. 371 of PCT Patent Application No. PCT/GB2018/053604, filed Dec. 12, 2019, which claims priority to United Kingdom Patent Application No. 1721631.8, filed Dec. 21, 2017, the entire contents of each of which are incorporated herein by reference.

TECHNICAL FIELD

The present invention relates to apparatuses, rails and methods for mounting facade units to a wall. The invention is particularly suitable for facade units such as brick slips, other fired clay units, masonry units, tiles and the like.

BACKGROUND

Traditional brickwork is popular in the construction of interior or exterior walls of buildings due to its durability and aesthetic appeal. However, bricks are relatively expensive to install and require the significant skill of a bricklayer to be installed correctly. They are also relatively heavy, which poses a problem of excessive loading in relatively tall buildings. As a result, facade units in the form of brick slips have become common in the construction of facade or cladding apparatuses for walls. Brick slips are effectively thin "slices" or tiles of a brick and are attached to the wall by a mounting apparatus. Brick slips provide similar weather resistance to traditional brickwork, but usually require lower installation skills. Furthermore, they are significantly lighter and can provide a brick facade to relatively tall buildings or towers.

GB-A-2199352 discloses a brick slip mounting apparatus in which a polystyrene board comprises a series of grooves is attached to a wall. The brick slips are initially fitted under friction into the grooves and adhered to the board. Subsequently a construction worker applies mortar into the gaps between the brick slips to simulate the aesthetics of traditional brickwork. However, the tolerances of the dimensions of brick slips are typically relatively large (frequently up to ±7 mm). As a result, if the brick slip is relatively small, the friction fit can have limited, if any, strength and the brick slip is held in place by the adhesive only. If the adhesive does not dry quickly enough, or is not strong enough, the brick slip can fall out before the mortar is applied. Furthermore, the mortar provides little structural support to the finished facade and as a result a weak adhesive connection can result in brick slips falling from the finished facade.

GB-A-2371314 sought to address these problems with a unit attached to a wall and having upward projections extending outwardly from the wall. The brick slips comprise a rearward facing groove and the upwards projections are located in the grooves to hold the brick slips in place. However, the apparatus requires particular extruded brick slips that increase the cost of construction and limit the availability of different types of bricks for use in the apparatus. For instance, it is not possible to use conventionally cut brick slips with the apparatus of GB-A-2371314.

SUMMARY OF INVENTION

An object of the present invention is therefore to provide an apparatus and method for securely mounting facade units to a wall. A further object is to enable the mounting of facade units of any type, particularly those with relatively high dimensional tolerances. A particular object is to enable the mounting of brick slips of different types and having high dimensional tolerances.

The present invention therefore provides a facade unit mounting apparatus comprising first and second supports for, in use, attachment to a wall and gripping at least one facade unit mounted therebetween, wherein the first support comprises at least one resilient elements configured to, in use, bias the at least one facade unit against the second support. The first support may comprise a first base for, in use, extending outwardly from the wall and a plurality of resilient elements. The plurality of resilient elements may be mounted to the first base and comprise a plurality of projections extending from the first base. The plurality of projections may be configured to extend inwardly and away from the first base for, in use, gripping the at least one facade unit against outward movement from the wall.

The present invention further provides a rail for an apparatus for mounting a plurality of facade units to a wall, the rail comprising: a first support of the aforementioned apparatus for a first row of facade units; and a second support of the aforementioned apparatus for a second row of facade units.

The present invention further provides a method of mounting at least one facade unit to a wall, the method comprising: attaching first and second supports to a wall, the first support comprising at least one resilient element; mounting at least one facade unit between the first and second supports such that the first and second supports grip the at least one facade unit, and the at least one resilient element biases the at least one facade unit against the second support. The first support may comprise: a first base extending outwardly from the wall; and a plurality of resilient elements mounted to the first base and comprising a plurality of projections extending from the first base inwardly and away from the first base. The plurality of projections may grip the at least one facade unit against outward movement from the wall.

The present invention further provides a rail for an apparatus for mounting a plurality of facade units to a wall, the rail comprising: an inner support for attachment to a wall; a common base extending from the inner support to, in use, extend outwardly from the wall, the common base comprising: a first support comprising at least one resilient element extending away from the common base configured to, in use, bias the at least one facade unit of a first row of facade units away from the common base; and a second support for supporting, in use, at least one facade unit of a second row of facade units biased against the second support. The inner support may comprise an inner base and at least one spacer attached to or formed with the inner base, the at least one spacer being configured for providing, in use, at least one second gap between the at least one facade unit of the first row and the inner base.

The plurality of resilient elements create a friction fit between the first and second supports by pushing the at least one facade unit against the second support. The plurality of resilient elements also allow different sizes of facade units to be mounted to the wall and the friction fit maintained. As a result, for example, brick slips with significantly different dimensions due to large manufacturing tolerances can be fitted to the wall.

The at least one resilient element may comprise a spring, a compression spring, a resilient wedge, a clip, a spring clip and/or a resilient lever.

DESCRIPTION OF DRAWINGS

By way of example only, embodiments of apparatuses, rails and methods for mounting facade units to a wall in accordance with the present invention are now described with reference to, and as shown in, the accompanying drawings, in which.

DETAILED DESCRIPTION

Figure 1:
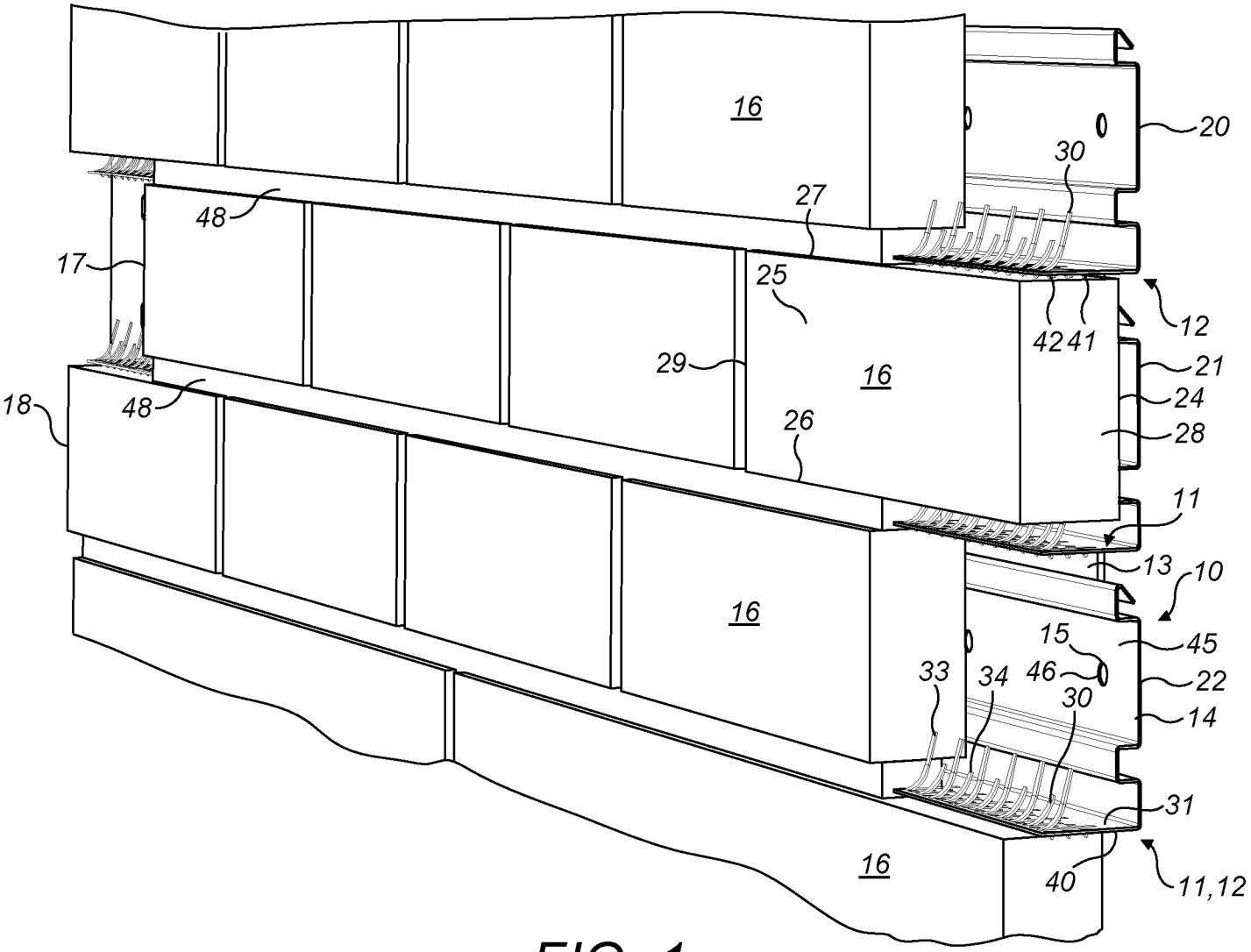
FIG. 1 is a perspective view of an apparatus according to the present invention.
Figure 2:
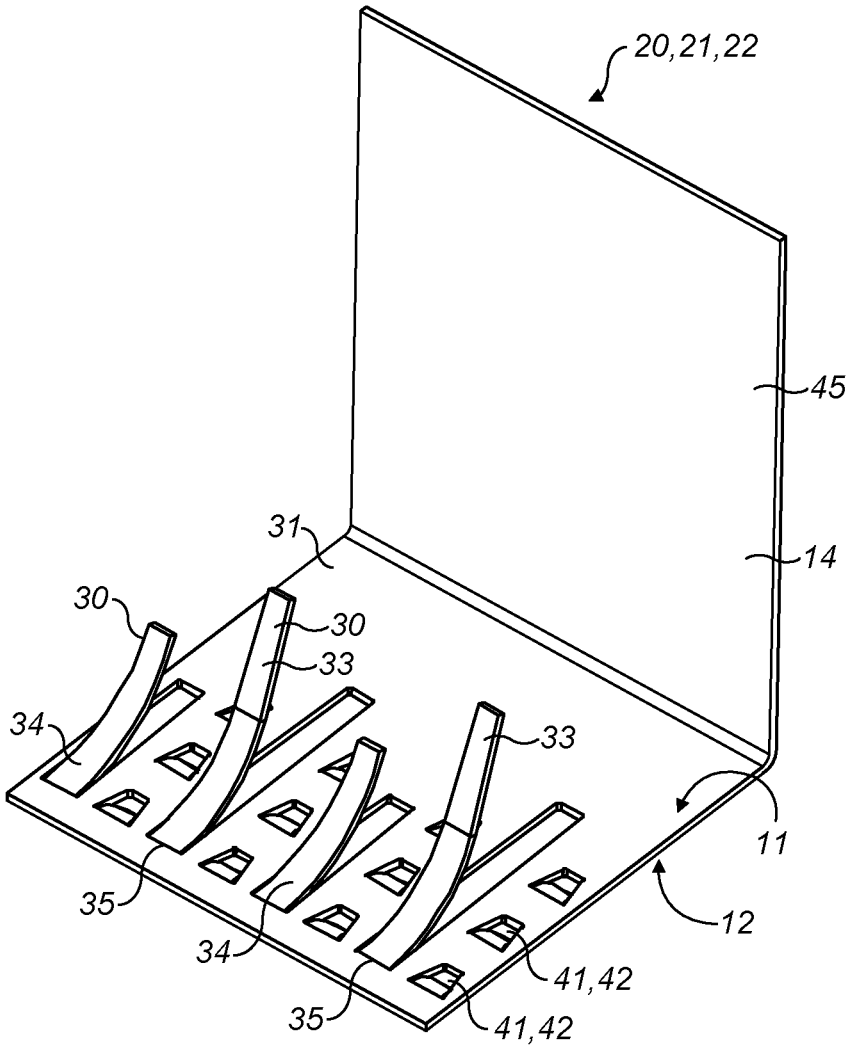
FIG. 2 is a perspective view of a rail of a further embodiment of an apparatus according to the present invention.

FIGS. 1 to 6 illustrate several different embodiments of an apparatus 10 according to the present invention. The same reference numerals have been used for corresponding features where suitable. The apparatus 10 comprises first and second supports 11, 12 attached to a wall 13 by at least one inner support 14 and/or at least one fastener 15. The first and second supports 11, 12 support at least one facade unit 16 therebetween.

Although the present description is generally directed towards applying at least one facade unit 16 to a vertical an planar wall 13, the present invention can also be used to apply at least one facade unit 16 to a wall 13 at any acute angle or a horizontal wall, floor, ceiling, roof, soffit and the like. Furthermore, the wall 13 need not be a solid wall, such as brick, concrete, rendered or the like, and may comprise one or more frames, rails, boards (particularly cement boards), columns, panels, pillars and the like. The wall 13 is generally considered to define a substantially flat wall plane and in the present disclosure a direction along the wall refers to a direction substantially parallel to the wall plane and an inward or outward direction refers to a direction substantially normal, or at an acute angle, to and towards or away from the wall plane.

Figure 3A:
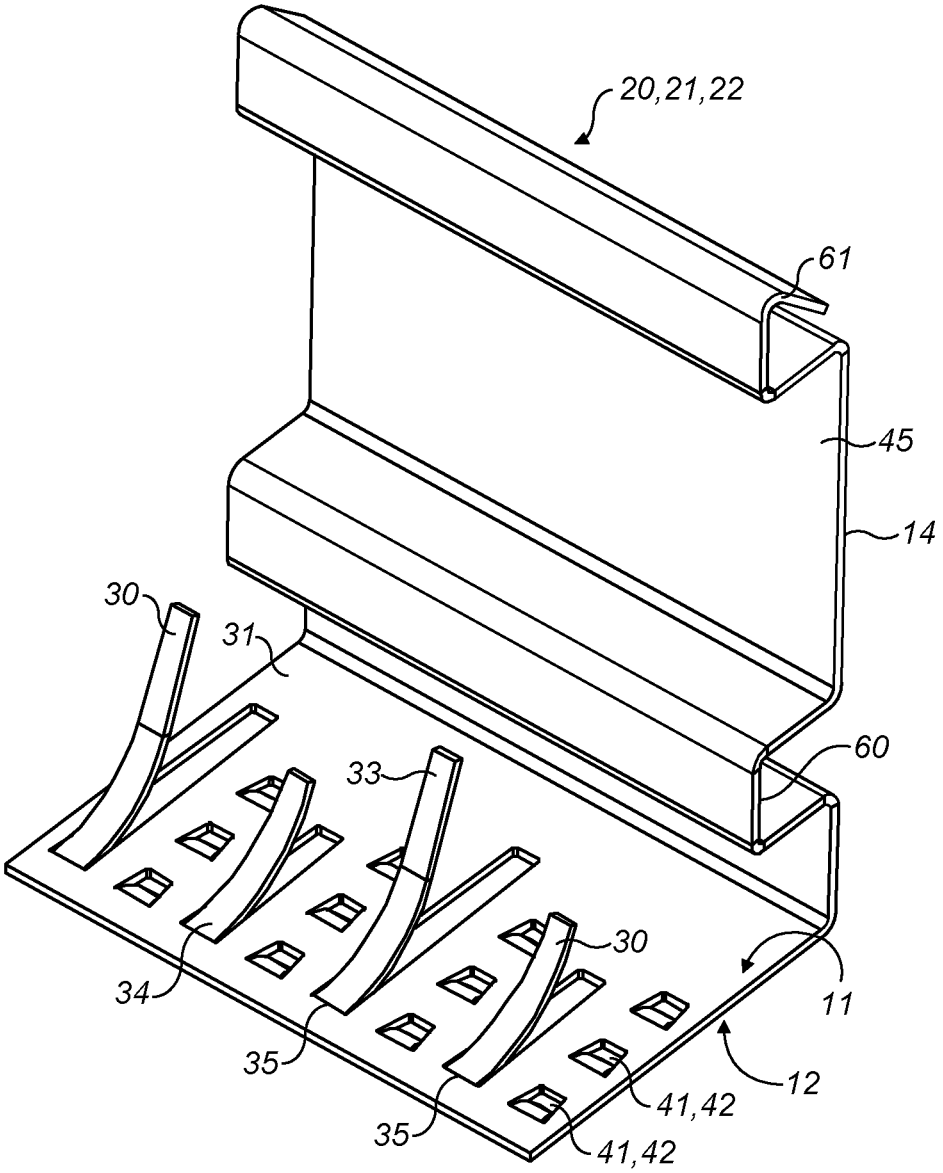
FIG. 3A is a perspective view of a rail of a yet further embodiment of an apparatus according to the present invention.
Figure 3B:
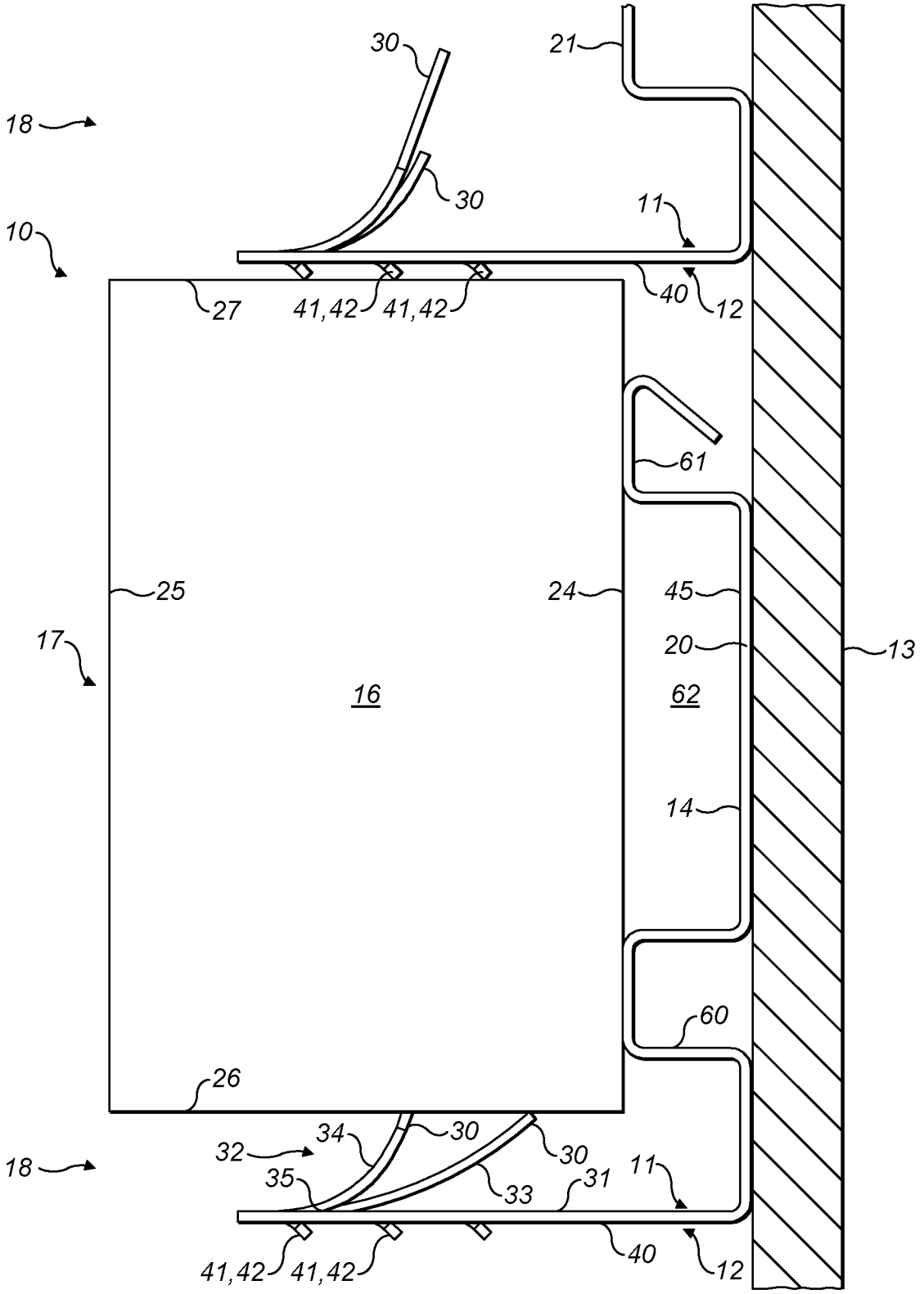
FIG. 3B is a cross-sectional side view of the apparatus including the rail of FIG. 3A.
Figure 6:
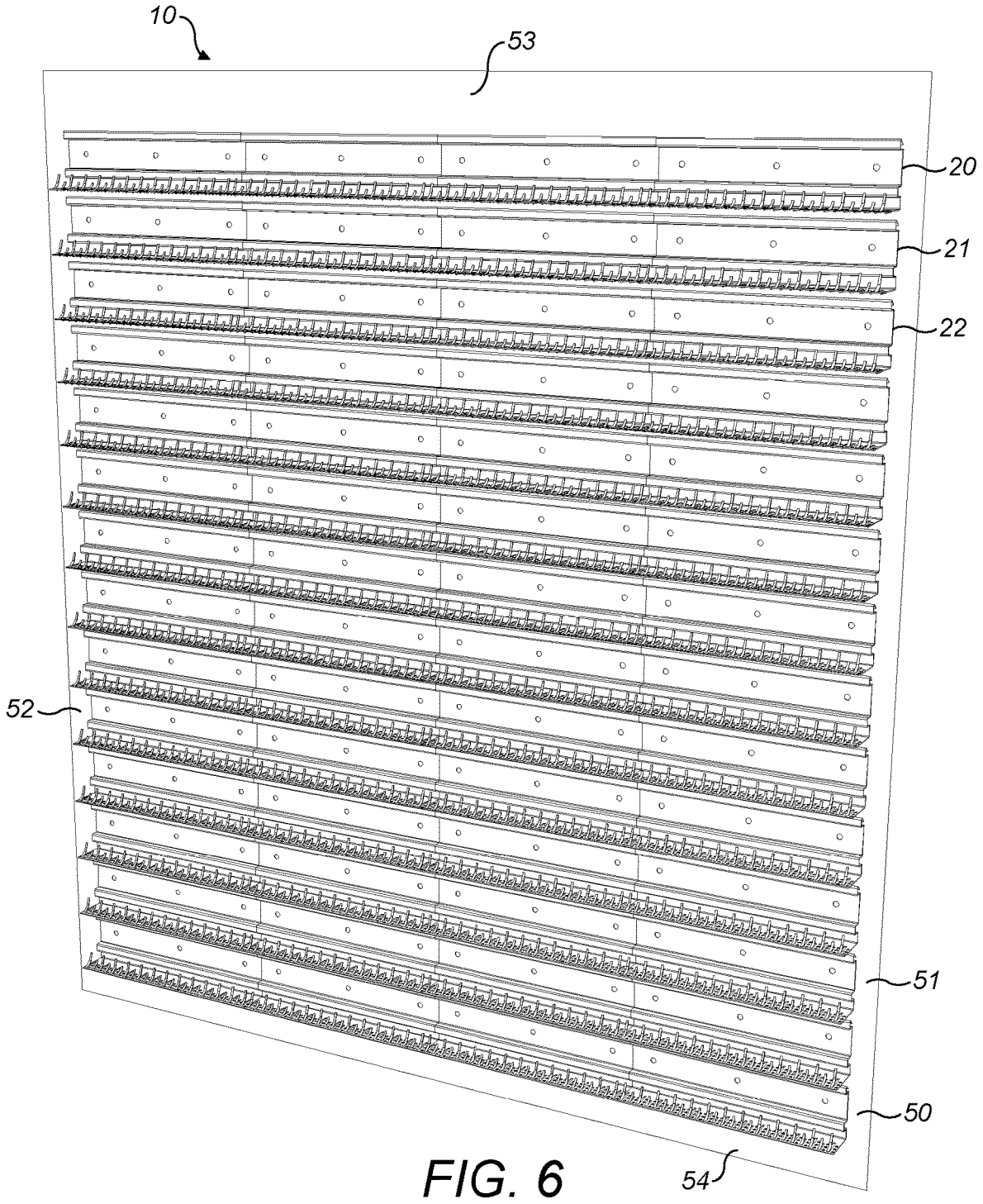
FIG. 6 is a perspective view of a yet further embodiment of an apparatus according to the present invention.

Preferably, as shown in FIGS. 1, 3B and 6, the apparatus 10 enables a plurality of rows 17, 18 of aligned facade units 16 to be mounted to the wall 13. Each row 17, 18 extends between first and second supports 11, 12 along the wall 13. The first and second supports 11, 12 may be spaced apart from one another to allow at least one facade unit 16 to be mounted therebetween. It is noted that each row 17, 18 need not be horizontal as illustrated, but may be vertical or at an acute angle. A first support 11, a second support 12 and an inner support 14 are provided for each row 17, 18 of adjacent facade units 16. The apparatus 10 preferably comprises at least one rail 20, 21, 22, 23 forming the first and second supports 11, 12 of each of the row 17, 18. Each rail 20, 21, 22, 23 comprises at least one first support 11, at least one second support 12 and at least one inner support 14, each being for the same or different rows 17, 18 of facade units 16.

Figure 4:
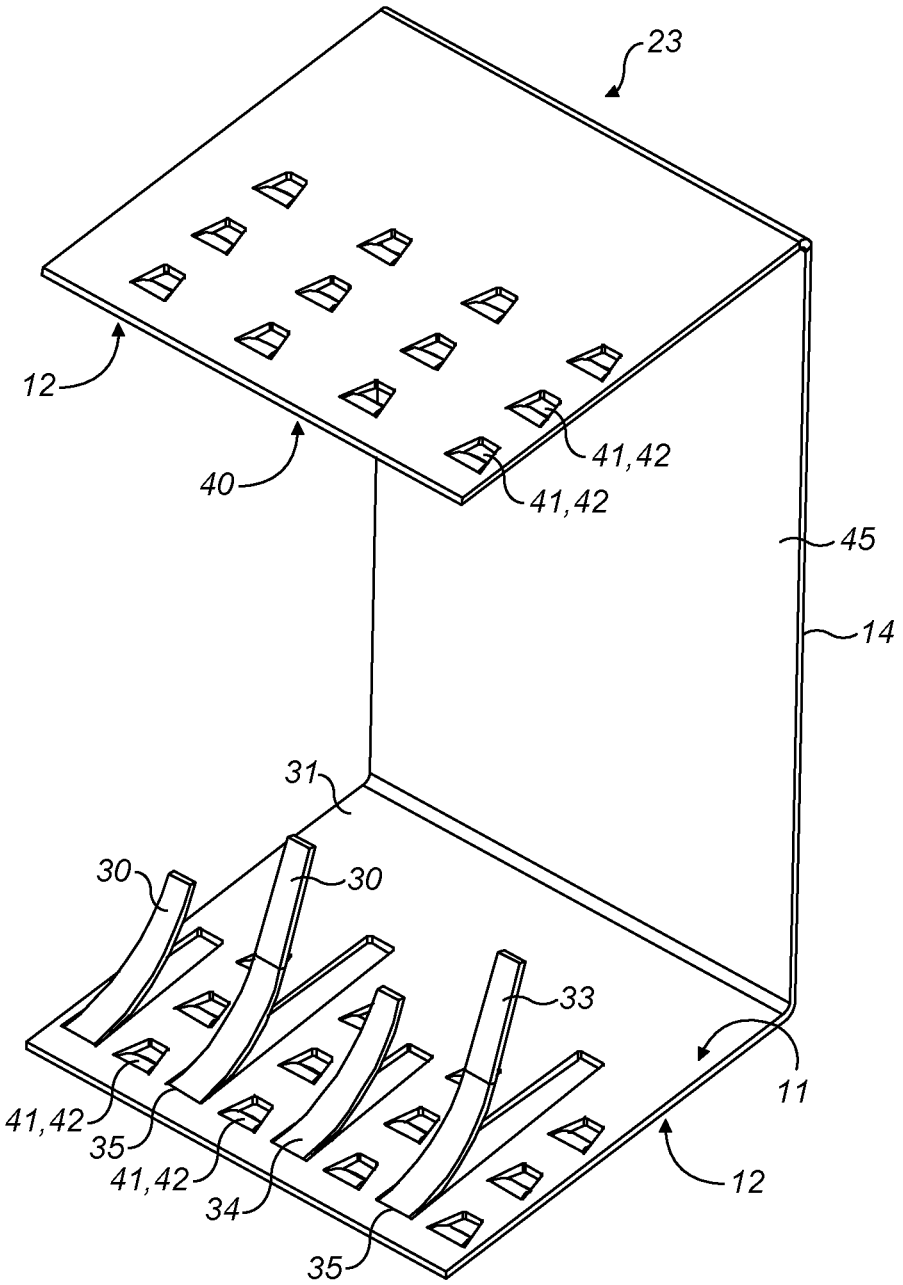
FIG. 4 is a perspective view of a rail of a yet further embodiment of an apparatus according to the present invention.
Figure 5:
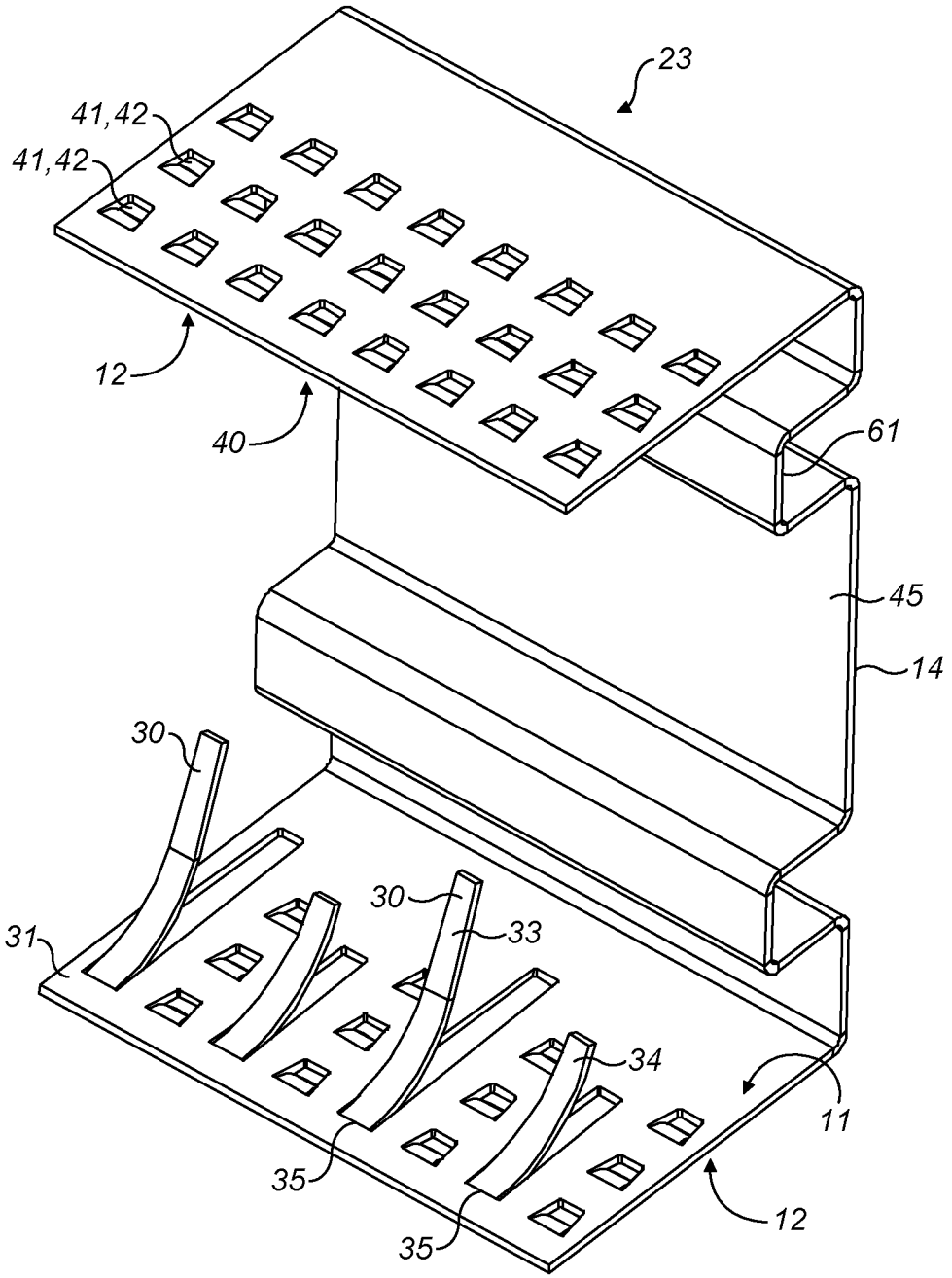
FIG. 5 is a perspective view of a rail of a yet further embodiment of an apparatus according to the present invention.

As in FIGS. 1, 2, 3A, 3B and 6, a first rail 20 may comprise the first support 11 of a first row 17 and a second rail 21 may comprise the second support 12 of the first row 17. The second rail 21 may comprise the first support 11 of a second row 18 and a third rail 22 may comprise the second support 12 of the second row 18. Each rail 20, 21, 22 therefore comprises the first support 11 of a first row 17, the second support 12 of a second row 18 and an inner support 14. Alternatively, an integral rail 23 may comprise both the first and second supports 11, 12 of a single first row 17, as shown in FIGS. 4 and 5, by connecting the first and second supports 11, 12 together by the an inner support 14. The integral rail 23 may also form the first and/or second support 11, 12 of a second row 18, as described in further details below.

The first and second supports 11, 12 grip at least a portion of at least one facade unit 16 between them, preferably such that the at least one facade unit 16 cannot be moved outwardly from the wall 13 easily, if at all. The first and second supports 11, 12 and at least one rail 20, 21, 22, 23 extend along the wall 13 along an extension axis such that they can support or hold one or more facade units 16 between them. Preferably the at least one rail 20, 21, 22, 23 can support at least two facade units 16, at least five facade units 16 or in the range of from two to fifty, more preferably two to twenty-five, facade units 16 inclusive.

The at least one facade unit 16 preferably comprises an inner side 24 adjacent the wall 13, an opposing outer side 25 furthest from the wall 13, first and second contact sides 26, 27 and ends 28, 29. The at least one facade unit 16 of the present invention may be any suitable tile (e.g. roof, wall or floor tiles), other fired clay units, masonry units and/or the like. The apparatus may hold the same type or a plurality of different types of facade units. However, as illustrated, preferably the at least one facade unit 16 comprises at least one brick slip. The brick slips may be formed by any suitable method, including but not limited to extrusion, moulding, pressing, hard throwing, fettling, cutting, slap moulding either as brick slips or as full-sized bricks that are subsequently cut into brick slips. The bricks may be of any suitable type, such as perforated, frogged or solid. The bricks and/or brick slips are typically made of fired clay, concrete, calcium silicate or the like. The brick slips may have dimensions of approximately 215 mm long, approximately 65 mm high and in the range of from approximately 25 mm to approximately 75 mm, preferably approximately 40 mm, thick. The full-sized bricks may have similar length and height with a thickness of approximately 100 mm to approximately 105 mm, preferably 102.5 mm. However, such dimensions will typically be determined based upon local customs and regulations. The at least one facade unit may comprise a substantially rectangular cuboid. The first and/or second contact sides may each comprise a substantially flat and/or planar surface extending between the edges of the facade unit. Although the surface may have small indentations, for example due to the usual roughness of bricks, the surface may not comprise substantial indentations or channels. In particular, the surface of the first and/or second contact sides may comprise no indentation deeper than approximately 10 mm, approximately 5 mm, approximately 3 mm or more preferably approximately 1 mm.

The first support 11 comprises at least one resilient element 30, preferably a plurality of resilient elements 30, that bias or push the at least one facade unit 16 against the second support 12, preferably by applying a spring force against it. In particular, the direction of the biasing force of the plurality of resilient elements 30 is along the wall 13, away from the first support 11, towards the second support 12 and perpendicular to the extension axes of the first and second supports 11, 12 along the wall 13. In the case of the first support 11 being located at the bottom of the apparatus 10, or underneath the at least one facade unit 16 as illustrated, the plurality of resilient elements 30 may be biased to push the at least one facade unit 16 upwards. The plurality of resilient elements 30 may be deformable, preferably elastically deformable, between a fully extended configuration and a compressed or retracted configuration. The plurality of resilient elements 30 are in the fully extended configuration before contact with the first contact side 26 of the at least one facade unit 16 and in the retracted configuration once the at least one facade unit 16 is mounted in between the first and second supports 11, 12. When in the retracted configuration the plurality of resilient elements 30 apply the biasing force to the at least one facade unit 16.

The plurality of resilient elements 30 are further configured to apply an inward gripping force against the at least one facade unit 16 in response to outward movement of the at least one facade unit 16 from the wall 13, particularly when in the retracted orientation. The inward gripping force is a reactionary frictional force acting against outward movement and thus preferably is in a direction towards the wall 13 substantially normal to the wall plane. For instance, the plurality of resilient elements 30 may comprise a highly frictional portion in contact with the first and/or second contact sides 26, 27 of the at least one facade unit 16. The highly frictional portion may be a region of relatively high surface roughness and/or a sharp edge that interacts with the surface roughness of the at least one facade unit 16 during relative movement.

The plurality of resilient elements 30 are mounted to and/or formed with a first base 31 of the first support 11, which extends outwardly from an inner edge adjacent the wall 13 to an outer edge separated from the wall 13. The first base 31 preferably extends outwardly in a direction substantially normal to the wall plane, although the first base 31 may extend outwardly at an acute angle to the wall plane. The first base 31 also preferably extends along the wall 13. Preferably the plurality of resilient elements 30, as illustrated, are located on the same side of the first base 31 as the second support 12 and preferably separates the at least one facade unit 16 and the first base 31 to create a first gap 32 therebetween when in the retracted orientation. The first base 31 may comprise any suitable rigid means, body or member for supporting or locating the plurality of resilient elements 30 in a position adjacent to (above or below) the first or second contact side 26, 27 of the at least one facade unit 16. As a result, the plurality of resilient elements 30 are spaced apart from the wall 13 in an inward or outward direction. As in the illustrated embodiments, the first base 31 may be substantially planar and may comprise a sheet or plate.

In the illustrated preferred embodiments the plurality of resilient elements 30 comprises a plurality of resilient levers or projections 33, 34 extending from the first base 31. The projections 33, 34 may each comprise an elongate body having a free end or tip, for contacting a contact side 26, 27 of at least one facade unit 16, and an opposing end attached to the first base 31 at a connection 35. The projections 33, 34 extend inwardly (e.g. towards the wall 13) and away from the first base 31 and, preferably, are curved with its convex side facing inwardly towards the wall 13 (i.e. the centre point of the radius of curvature is on the opposing side of the projection(s) 33, 34 to the wall 13 as illustrated). The projections 33, 34 may alternatively be straight.

The projections 33, 34 are configured to apply the biasing force by being elastically deformable along its length and/or at the connection 35 such that the free end or tip is displaceable, and biased, from retracted orientation to the extended orientation. In particular, when not at rest in the extended orientation, the projections 33, 34 apply a spring force upwardly substantially parallel to the wall plane and towards the second support 12. The projections 33, 34 are configured to apply the inward gripping force by virtue of the inwardly directed free end or tip having a relatively sharp edge providing a high friction contact with the at least one facade unit 16. Furthermore, the projections 33, 34 are sufficiently rigid or stiff in the outward and inward direction such that it does not plastically deform, and does not substantially elastically deform, in response to outward movement of the at least one facade unit 16.

The dimensions and materials of the projections 33, 34 are selected to provide suitable biasing and inward gripping forces. For instance, the each projection 33, 34 may be approximately 3 mm to approximately 4 mm wide (e.g. 3.5 mm wide), approximately 1 mm thick (e.g. 0.8 mm thick) and approximately 10 mm to 30 mm long. The projections 33, 34 are preferably made from suitably resilient material such as stainless steel, other steels, aluminium, plastics (e.g. nylons) and the like. Each projection 33, 34 preferably tapers from a larger width at the connection 35 to a narrower width at its free end. As a result, each projection 33, 34 has a strong bond with the first base 31 at the connection 35 and a sharper tip for gripping the facade unit 16.

Preferably the first support 11 comprises a plurality of resilient first and second projections 33, 34, wherein the at least one first projection 33 is longer than the at least one second projection 34. In particular, the distance between the free end of the at least one first projection 33 and its connection 35 is greater than the distance between the free end of the at least one second projection 34 and its connection 35. As a result, the first support 11 can effectively grip smaller facade units 16 and larger facade units 16 by applying effective biasing and inward gripping forces from the second or first projections 34, 33 respectively. The at least one first projection 33 is preferably approximately 5 mm to 15 mm longer than the at least one second projection 34. The at least one first projection 33 is preferably approximately 20 mm to approximately 30 mm long and the at least one second projection 34 is preferably approximately 10 mm to approximately 20 mm long.

The second support 12 supports the at least one facade unit 16 pressed against it and maintains the (e.g. horizontal) orientation of the at least one facade unit 16. Thus the second support 12 preferably defines a flat second support plane and it keeps the at least one facade unit 16 parallel to the second support plane. The second support plane preferably extends along the wall 13 normal to the wall plane. The second support 12 may comprise a second base 40. The second base 40 may be substantially rigid, planar and extend outwardly from the wall 13. The second base 40 preferably has the same construction as the first base 31, such as by comprising a sheet or plate as shown.

The second support 12 further preferably comprises at least one grip element 41 mounted to the second base 40 that grips the at least one facade unit 16. The at least one grip element 41 is configured to apply an inward gripping force against the at least one facade unit 16 in response to outward movement of the at least one facade unit 16 from the wall 13 (in a similar manner to the reactionary inward gripping force of the plurality of resilient elements 30). For example, as illustrated, the at least one grip element 41 comprises at least one substantially rigid tooth 42 extending inwardly towards the wall 13 and towards the first support 11. The at least one tooth 42 applies the inward gripping force via the highly frictional contact of a sharp edge, similar to the projections 33, 34. However, the at least one tooth 42 is shorter than the projections 33, 34 and does not provide a substantial biasing force against the at least one facade unit 16, contrary to the least one projection 33, 34. In particular, the at least one tooth 42 is stiffer or more rigid than the projections 33, 34. The at least one tooth 42 is preferably approximately 1 mm to approximately 4 mm long.

Preferably the second support 12 comprises a plurality of teeth 42, the ends of which form the second support plane. The plurality of teeth 42 are preferably evenly distributed and extend from the second base 40 by the same distance such that the second support plane is maintained and the at least one facade unit 16 is aligned with it. The teeth 42 may be distributed in a grid as illustrated, which has rows of three teeth 42. The grid of teeth 42 may extend from adjacent the outer edge and may substantially extend over the second contact surface 27 to provide a relatively large surface area of grip. For instance, the teeth may be distributed in a grid that extends over at least 75% of the second contact surface 27.

The at least one inner support 14 may comprise at least part of the at least one fastener 15. For instance, as illustrated in FIG. 1, the at least one inner support 14 comprises an inner base 45 in the form of a sheet and at least one hole 46 through it. The at least one fastener 15 may comprise a screw, rivet or other fastener inserted through at least one the hole 46 into the wall 13. Any other suitable fastener 15 may be used, such as adhesive, welding or the like, provided that it enables both the weight of the at least one rail 20, 21, 22, 23 and at least one facade unit 16 to be supported.

It will be appreciated that the first base 31 of the first support 11 of the first row 17 of facade units 16 is the same as or forms the second base 40 of the second support 12 of the second row 18 of facade units 16. Thus the first and second bases 31, 40 comprise a common base 31, 40, which may be a substantially planar body or sheet, and one side of the common base 31, 40 forms the first support 11 of the first row 17 whilst its other side forms the second support 12 of the second row 18. In the case of separate rails 20, 21, 22 forming the first and second supports 11, 12 of a single row 17, 18, the common base 31, 40 is attached, for example by a substantially perpendicular bend as shown, to the sheet of an inner support 14. In the case of an integral rail 23, the common base 31, 40 for first and second rows 17, 18 is similarly formed and attached to a second support 12 for the first row 17 by the inner support 14, for example by two substantially perpendicular bends as shown.

The rails 20, 21, 22, 23 are preferably formed from sheet, such as a metal, stainless steel, other steels, aluminium, plastics (e.g. nylons) and the like. The first and second supports 11, 12 and inner support 14 of each rail 20, 21, 22, 23 may be formed in any suitable way, such as by extrusion, rolling and/or bending of a sheet. The plurality of resilient elements 30 and at least one grip element 41 are preferably forming by cutting (e.g. laser cutting), punching and/or bending from the sheet. The material of the rails 20, 21, 22, 23 is selected to enable the plastic deformation of the sheet to form the projections 33, 34 and/or at least one tooth 42 and to subsequently ensure that they can elastically deform after formation and during use. The length of the rails 20, 21, 22, 23 is selected to ensure that they can be fastened between fastening points on the wall 13 at certain differences from one another, such as between spaced vertical columns.

In order to mount a facade unit 16 to the wall 13, the first and second supports 11, 12 are attached to the wall 13 by the at least one inner support 14 and at least one fastener 15. For example, first and second rails 20, 21 may be mounted to the walls to form first and second supports 11, 12 of a first row 17 of facade units 16. Alternatively, an integral rail 23 comprising the first and second supports 11, 12 of a first row 17 is attached to the wall 13. For example, the at least one rail 20, 21, 22, 23 may be attached to a solid wall 13 by a plurality of screws and/or an adhesive. Alternatively, the at least one rail 20, 21, 22, 23 may be attached to one or more columns, pillars, bars or the like, preferably together defining a wall plane, by a plurality of screws and/or an adhesive.

Subsequently, a facade unit 16 is located and pushed in between the first and second supports 11, 12 by elastically deforming the plurality of resilient elements 30 away from the second support 12. Once pushed fully into between the first and second supports 11, 12, the plurality of resilient elements 30 push the facade unit 16 upwardly and into the second support 11, 12, thereby creating a friction fit to keep the facade unit 16 in place. The plurality of resilient elements 30 and, if present, at least one grip element 41, apply a gripping force in reaction to any attempt to remove the facade unit 16 from the apparatus 10.

One or more further facade units 16 may then be mounted along the first row 17 in a similar manner and further rows 18 may be added by mounting facade units 16 in between yet further rails 20, 21, 22, 23. The rails 20, 21, 22, 23 are spaced apart from one another to suit the general dimensions of the facade units 16, although the plurality of resilient elements 30 will account for differences in tolerances. In the integral rail 23 the height of the inner support 14 is selected such that the spacing of the first and second supports 11, 12 matches that of the general dimensions of the facade units 16. Along each row 17, 18 adjacent facade units 16 may be separated by spacers, such as plastic or metal bodies of substantially the same width, to ensure that they are evenly spaced.

Subsequently the installer applies mortar 48 or another binding material into the space around each facade unit 16 to point the plurality of facade units 16. In particular, the mortar 48 may comprise a mixture of cement, sand, water and/or lime or any other binding material used in building to bond or seal facade units 16, bricks or stones. The binding material may be grout, mastics, silicones, sealants, adhesives, fillers, resins and the like.

The mortar 48 is preferably applied between each facade unit 16 and into the first gap 32 between each facade unit 16 and its corresponding first base 31 of the first support 11, around the plurality of resilient elements 30. The mortar 48 may further be applied around the at least one grip element 41 and in between the second base 40 of the second support 11 and the facade unit 16. Furthermore, the mortar 48 may be injected under sufficient pressure that it reaches into any gap between the facade unit 16 and the inner support 14 and/or wall 13.

The first support 11 therefore enables a variety of different sizes of facade units 16 to be fitted to each row. In particular, the distance between the first and second bases 31, 40 is greater than the height of each facade unit 16. The plurality of resilient elements 30 extend away from the first base 31 in a resilient manner to compensate for different sizes of facade units 16. The second support 12 also keeps each facade unit 16 aligned along the second support plane such that they are all aligned with one another, thereby ensuring a neat appearance. The integrated rail 23 allows for a final or end row 17, 18 of facade units 16 to be mounted to the wall 13 without leaving a spare first, second and/or inner support 11, 12, 14 thereby ensuring that the apparatus 10 can be installed neatly.

The friction between the at least one facade unit 16 and the second support 12 preferably keeps the at least one facade unit 16 in place prior to application of the mortar 48. The gripping force of the plurality of resilient elements 30 and/or at least one grip element 41 also provides a substantial reactionary force against any attempt to remove each facade unit 16, both before and after application of the mortar 48. The plurality of resilient elements 30 also acts as a shear key against the removal of the mortar 48 by being embedded within the mortar 48. Since the plurality of resilient elements are embedded within the mortar 48, the mortar 48 also prevents the plurality of resilient elements 30 from bending upon application of a removal force. Thus the mortar 48 improves or prevents reduction of the reactionary inward gripping force of the plurality of resilient elements 30.

Various alternatives to the embodiments described above also fall within the scope of the present invention. For example, the second support 12 may comprise at least one resilient element 30 extending from the second base 40 towards the first support 11 in a similar manner to the plurality of resilient elements 30 of the first support 11 described above. Thus the apparatus 10 could compensate for even greater variations in dimensions of the facade units 16.

In the illustrated embodiments the connections 35 of the projections 33, 34 lie along a common axis extending parallel to and along the wall 13. In other embodiments the connections 35 may be at different distances, such as by being in a castellated arrangement, from the inner and outer edges for different projections 33, 34.

The connections 35 are preferably closer to the outer edge than the inner edge of the first base 31 and, as illustrated, may be substantially adjacent to the outer edge. For instance, the connections 35 may lie at a distance from the outer edge of up to approximately 50%, more preferably approximately 25%, of the entire depth of the first base 31 (i.e. the distance from the outer edge to the inner edge or wall 13). As a result, the spring force of the plurality of resilient elements 30 acting against at least one facade unit 16 is transferred into a downward force from the at least one grip element 41 to the facade unit(s) 16 in which it is in contact. The common base 31, 40 acts as a cantilever. Thus the at least one grip element 41 applies a relatively greater force to the at least one facade unit 16.

The plurality of resilient elements 30 may also have any other form rather than the projections 33, 34. The plurality of resilient elements 30 may be formed separately to the first base 31 and attached or otherwise mounted thereto. For example the plurality of resilient elements 30 may comprise a compression spring arrangement located between the first base 31 and at least one facade unit 16. The compression spring may be mounted in a spring bar having a first end mounted to the first base 31 and a second end pressing against the at least one facade unit 16. Alternatively the plurality of resilient elements 30 may comprise a resilient wedge, for example made of a rubber or resiliently flexible plastic, installed between the at least one facade unit 16 and first base 31.

Figure 7:
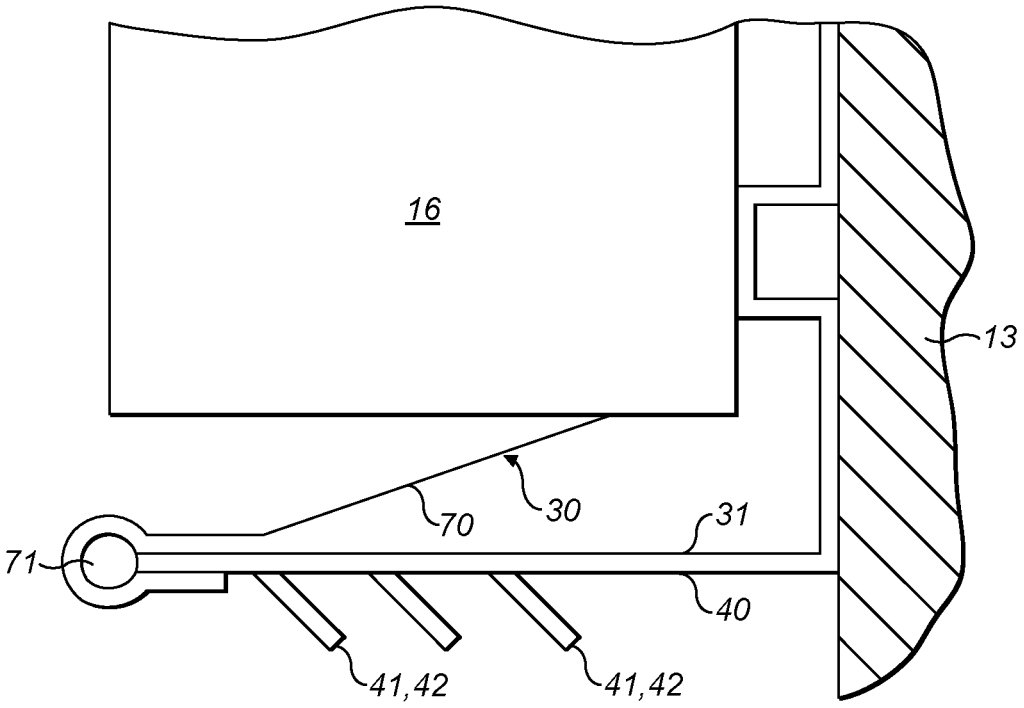
FIG. 7 is a cross-sectional view of an embodiment according to the present invention in which a plurality of resilient elements comprises a spring clip.

FIG. 7 illustrates an embodiment in which the plurality of resilient elements 30 comprises a clip 70, preferably a spring clip, mounted over the outer edge of the first, second and common base 31, 40. The clip 70 may extend from the second base 40, around the outer edge and to the first base 31, where it contacts the at least one facade unit 16 to bias it away from the first base 31. The outer edge may comprise a mount for supporting the clip 70, which in the illustrated embodiment is a bead extending along the outer edge for being received in a correspondingly shaped region of the clip 70.

The at least one grip element 41 may also have any other suitable form rather than the at least one tooth 42. For example, it may comprise an area of very high surface roughness, such as sand paper, knurling, serrations or the like. The at least one grip element 41 may also be applied on an intermediate body, such as a strip, patch, tape or the like, to the second or common base 40. For instance, a strip comprising the area of high surface roughness may be adhered to the second or common base 40.

FIG. 6 illustrates a particular embodiment in which the apparatus 10 comprises a unit 50 having a plurality of rails 20, 21, 22, 23 defining a plurality of first and second supports 11, 12 for forming a plurality of rows 17, 18 of facade units 16. The unit 50 comprises connectors 51, 52, 53, 54, such as a series of columns, bars or a planar sheet, for connecting a plurality of rails 20, 21, 22, 23 to one another. In the illustrated embodiment two edge connectors 51, 52 are attached to the opposing ends of the rails 20, 21, 22, 23, a first end connector 52 is attached to the first ends of the edge connectors 51, 52 and a second end connector 53 is attached to the second ends of the edge connectors 51, 52. The unit 50 can be fixed to the wall 13 by one of more fasteners 15 through any part thereof.

Such an integrated unit 50 enables a plurality of rails 20, 21, 22, 23 to be fitted to a wall 13 quickly and easily, therefore further reducing the time for and complexity of installation. In addition, the facade units 16 could be installed onto the unit 50 off-site (i.e. at a location remote to the building or other location in which they are to be permanently located). Thus the facade units 16 and mortar 48 could be applied to the unit 50 indoors, thereby avoiding any delays due to rain (during which it is best practice to not apply mortar 48).

Yet furthermore, each rail 20, 21, 22 may define just a first and/or second support 11, 12. For example, the rail 20, 21, 22 may be similar to that of FIGS. 2 and 3A except without the plurality of resilient elements 30 so that it only forms the second support 12 or without the at least one grip element 41 so that it only forms the first support 11. Such an arrangement is particularly beneficial for forming the top, bottom or end row of a plurality of rows 17, 18 of facade units 16 where the first or second support 11, 12 is not necessary.

As illustrated in FIGS. 3A, 3B and 5, the at least one inner support 14 may comprise at least one inner spacer 60, 61 for supporting the at least one facade unit 16 and spacing it from the inner base 45 and/or wall 13 by a second gap 62. The at least one inner spacer 60, 61 extends outwardly from the wall 13 and is located to contact the inner side 24 of the at least one facade unit 16. For example, the inner spacer 60, 61 may comprise a shaped U-section forming part of the sheet of the inner support 14, for example formed during the rolling process. Alternatively, as in FIGS. 3A and 3B, an inner spacer 61 may comprise a folded back portion at the end of the sheet forming the inner support 14. If there are a plurality of inner spacers 60, 61 then they preferably extend outwardly from the wall 13 by the same distance such that the width of the second gap 62 is the same along the wall 13. The at least one inner spacer 60, 61 enables mortar to be applied into the second gap 62 and thus provides additional bonding surfaces and strength. Yet furthermore, the at least one inner spacer 60, 61 provides a rear surface or support against which the installer can push the at least one facade unit 16 during installation, ensuring that the outer sides 25 of the facade units 16 are substantially aligned with one another.

The invention claimed is:

1. A rail for mounting a plurality of facade units to a wall, comprising:

an inner support;

a first support comprising:

a first base extending from the inner support and substantially normal to the inner support, wherein the first base is a single flange; and a plurality of resilient elements mounted to the single flange and comprising a plurality of projections extending from the single flange; and an inner spacer attached to the inner support wherein:

the first support is configured to grip at least one facade unit mounted between the first support and another first support of another rail;

wherein the inner spacer comprises an inner base and at least one spacer attached to the inner base, the at least one spacer being configured for providing at least one gap between the at least one facade unit and the inner base and/or the wall;

the plurality of resilient elements are configured to bias the at least one facade unit against the other first support; and the plurality of projections are configured to extend towards the inner support and away from the first base for gripping the at least one facade unit against movement away from the inner support.

2. A method of manufacturing the rail of claim 1, comprising:

forming the rail by extrusion, rolling and/or bending of a sheet; and cutting, punching and/or forming the plurality of resilient elements from the sheet.

3. A facade unit mounting apparatus, comprising:

a first support attached to a wall, the first support comprising:

a first base extending outwardly from the wall, wherein the first base is a single flange; and a plurality of resilient elements mounted to the single flange and comprising a plurality of projections extending from the single flange;

a second support attached to the wall;

at least one inner support attached to the first and/or second support, wherein:

the first and second supports are configured to grip at least one facade unit mounted between the first and second supports;

wherein the at least one inner support comprises an inner base and at least one spacer attached to the inner base, the at least one spacer being configured for providing at least one gap between the at least one facade unit and the inner base and/or the wall;

the plurality of resilient elements are configured to bias the at least one facade unit against the second support; and the plurality of projections extend inwardly towards the wall and away from the first base and are configured to grip the at least one facade unit against outward movement from the wall.

4. The facade unit mounting apparatus as claimed in claim 3 further comprising first and second rails, the first rail comprising the first support and the second rail comprising the second support.

5. The facade unit mounting apparatus as claimed in claim 3 comprising a rail, the rail comprising the first and second supports.

6. The facade unit mounting apparatus as claimed in claim 3 further comprising the at least one facade unit mounted between the first and second supports.

7. The facade unit mounting apparatus as claimed in claim 3 wherein each projection comprises a tip for contacting a first contact side of the at least one facade unit.

8. The facade unit mounting apparatus as claimed in claim 7 wherein the first base comprises a body for supporting or locating the plurality of resilient elements in a position adjacent to the first contact side of the at least one facade unit, wherein the first contact side of the at least one facade unit is planar and parallel to the first base.

9. The facade unit mounting apparatus as claimed in claim 3 wherein the plurality of resilient elements are configured to bias the at least one facade unit away from the first base and/or to separate the at least one facade unit and the first base.

10. The facade unit mounting apparatus as claimed in claim 3 wherein the plurality of resilient elements create a friction fit of the at least one facade unit between the first and second supports by pushing the at least one facade unit against the second support.

11. The facade unit mounting apparatus as claimed in claim 3 wherein at least one first projection of the plurality of projections is longer than at least one second projection of the plurality of projections.

12. The facade unit mounting apparatus as claimed in claim 3 wherein each projection is curved with a convex side of each projection facing inwardly towards the wall.

13. The facade unit mounting apparatus as claimed in claim 3 wherein the second support comprises a second base configured to extend outwardly from the wall and at least one grip element mounted to the second base configured to grip the at least one facade unit mounted between the first and second supports.

14. The facade unit mounting apparatus as claimed in claim 13 wherein the at least one grip element comprises at least one tooth configured to extend inwardly towards the wall and towards the first support.

15. A method of mounting at least one facade unit to a wall, the method comprising:

attaching first and second supports to a wall, the first support comprising:

a first base extending outwardly from the wall, wherein the first base is a single flange; and a plurality of resilient elements mounted to the single flange and comprising a plurality of projections extending from the single flange inwardly towards the wall and away from the single flange;

mounting at least one facade unit between the first and second supports such that the first and second supports grip the at least one facade unit, the plurality of projections grip the at least one facade unit against outward movement from the wall and the plurality of resilient elements bias the at least one facade unit against the second support;

wherein the first and/or second support is attached to the wall by at least one inner support, the at least one inner support comprising an inner base and at least one spacer attached to the inner base, the at least one spacer providing at least one second gap between the at least one facade unit and the inner base, wherein the method further comprises supplying a binding material into the at least one second gap.

16. The method as claimed in claim 15 wherein the plurality of resilient elements separates the at least one facade unit and the first base by at least one first gap, the method further comprising supplying a binding material around the plurality of resilient elements and into the at least one first gap.

* * * * *